United States Patent [19]

Motley

[11] Patent Number: 4,914,755

[45] Date of Patent: Apr. 10, 1990

[54] LETTER AND FIGURE CAP

[76] Inventor: Robert L. Motley, P.O. Box 369, Madison, Conn. 06443

[21] Appl. No.: 291,775

[22] Filed: Dec. 29, 1988

[51] Int. Cl.[4] ..... A42C 5/00

[52] U.S. Cl. ..... 2/185 R; 2/186; 2/199

[58] Field of Search ..... 2/171, 175, 178, 185 R, 2/186, 191, 195, 199, 209.3, 209.4, 209.5, 209.7; D2/250, 257, 248, 260, 263, 509

[56] References Cited

U.S. PATENT DOCUMENTS

| | | | |
|---|---|---|---|
| D. 229,525 | 12/1973 | Kobashikawa | D2/257 |
| D. 258,323 | 2/1981 | Lewis | D2/248 |
| 1,163,054 | 12/1915 | Williams | 2/191 |
| 1,581,750 | 4/1926 | Mantilla | 2/209.5 |
| 1,624,727 | 4/1927 | Goldberg | 2/209.3 |
| 1,704,576 | 3/1929 | Pellegrino | 2/209.7 |
| 2,735,109 | 2/1956 | Feldman | 2/195 |
| 2,749,555 | 6/1956 | Oliveria | 2/199 |
| 3,869,727 | 3/1975 | Hartman | 2/175 |

FOREIGN PATENT DOCUMENTS

| | | | |
|---|---|---|---|
| 2509584 | 1/1983 | France | 2/178 |

*Primary Examiner*—Werner H. Schroeder
*Assistant Examiner*—Diana L. Biefeld
*Attorney, Agent, or Firm*—Fleit, Jacobson, Cohn, Price, Holman & Stern

[57] ABSTRACT

A cap or hat having various arrangements in which alphabetical letters, numerals and other symbols are concealed or revealed in relation to the article of headwear to provide a cap or hat that is unique in construction and can be adapted to various arrangements in which letters, figures, numerals and the like can be observed or concealed.

4 Claims, 2 Drawing Sheets

LETTER AND FIGURE CAP

BACKGROUND OF THE INVENTION

1. Field of the Invention

The present invention generally relates to an article of headwear in the form of a cap or hat having various arrangements in which alphabetical letters, numerals and other symbols are concealed or revealed in relation to the article of headwear to provide a cap or hat that is unique in construction and can be adapted to various arrangements in which letters, figures, numerals and the like can be observed or concealed.

2. Information Disclosure Statement

Hats of various shapes and configurations have been provided and caps have been provided with various types of indicia relating to team names, symbols and various messages, slogans or similar indicia. Such caps or hats serve a functional purpose and also serve a purpose of imparting a message or information to an observer. However, none of the prior art discloses an arrangement in which letters or numerals can be moved from a concealed position to a revealed position nor do the prior patents disclose structural arrangements having peripherally oriented letters, numerals and the like that are observable when the cap or hat is being worn.

SUMMARY OF THE INVENTION

An object of the present invention is to provide a cap having a crown portion which covers and is mounted on the head of a wearer with a peripheral brim being mounted thereon in which the brim is provided with a plurality of letters or numerals associated therewith which pivot from a concealed position between two layers of the brim to a revealed position projecting radially from the brim.

Another object of the invention is to provide a cap in which the brim itself is in the form of a figure or letter.

A further object of the invention is to provide a cap having a crown portion provided with peripherally oriented letters extending from the lower edge portion of the crown to the upper edge portion thereof in which the lower edge of the crown is defined by a band and the upper edge of the crown portion is defined by an annular top member.

Still another object of the invention is to provide an article of headwear in the form of a hat or cap having various arrangements of alphabetical letters, numerals, symbols, figures and other well-known emblems and the like associated therewith in order to enable these items to be observed when the hat or cap is being worn with the hat or cap being unique in construction and capable of being made in various shapes, configurations, colors and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
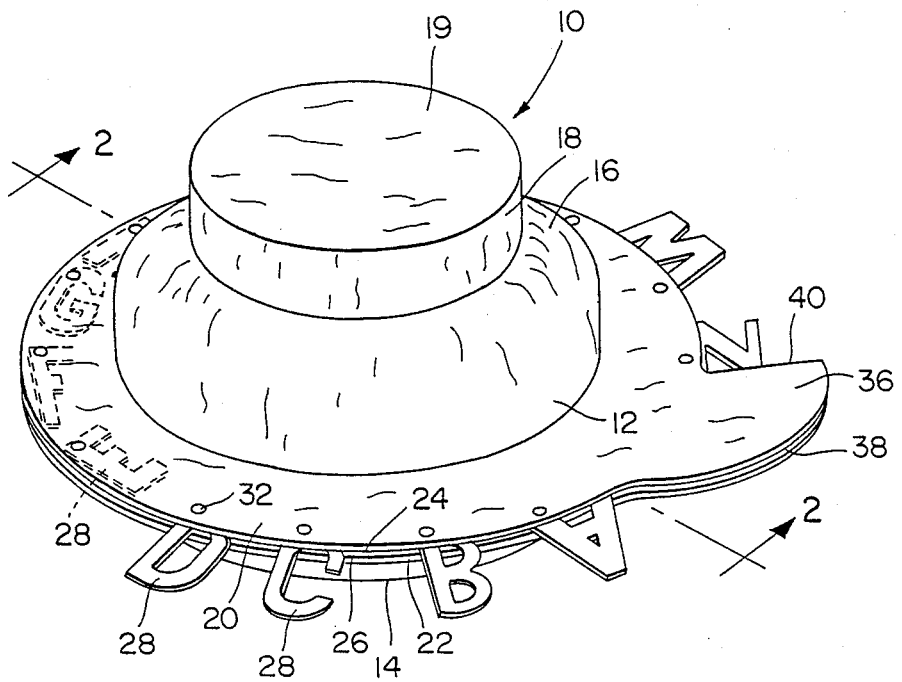
FIG. 1 is a perspective view of the cap of the present invention.
Figure 2:
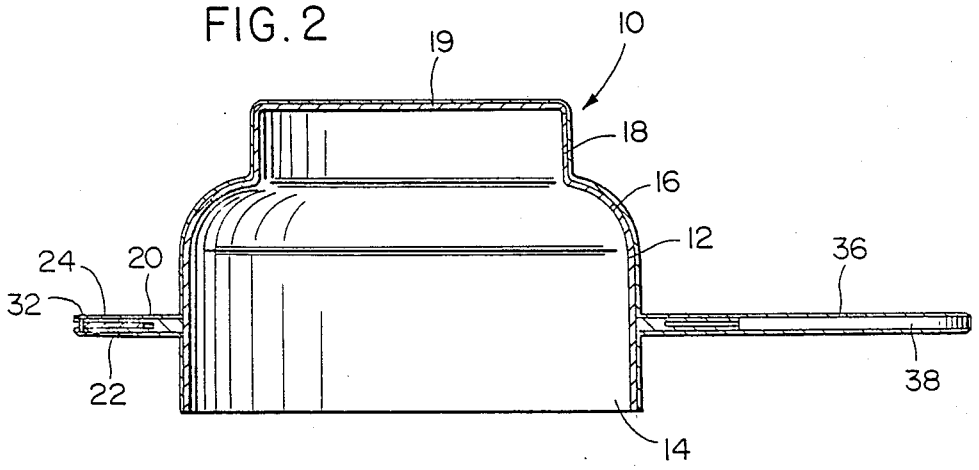
FIG. 2 is a transverse, sectional view taken substantially a plane passing along section line 2—2 on FIG. 1 illustrating specific structural details of the cap illustrated in FIG. 1.
Figure 3:
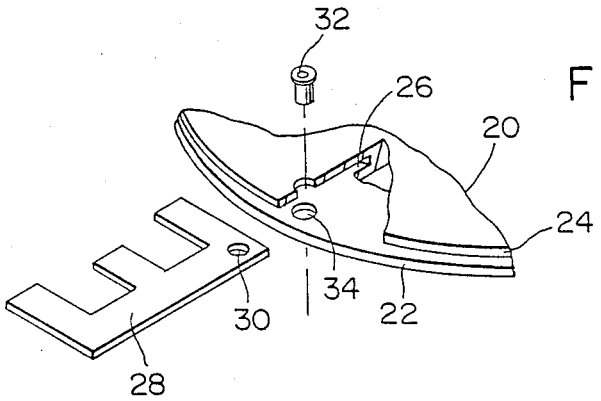
FIG. 3 is a fragmental, perspective view, on an enlarged scale, with portions broken away, illustrating the structure for pivotally mounting letters between upper and lower layers of the brim of the cap.

Referring now specifically to FIGS. 1-3, the cap of the

DESCRIPTION OF THE PREFERRED EMBODIMENTS

Referring now specifically to FIGS. 1–3, the cap of the present invention is generally designated by the reference numeral 10 and includes a crown portion 12 of generally cylindrical configuration which has an open lower end 14 to fit on and receive the upper portion or crown portion of the head of a wearer. The upper end of the cylindrical crown portion 12 curves inwardly at 16 to a cylindrical upper end 18 that has a closure top member 19 connected thereto in unitary construction therewith so that the top member 19 is substantially circular, the member 18 is substantially cylindrical, the member 12 is substantially cylindrical but larger in diameter than the cylindrical member 18 with the inwardly curved portion 16 joining the cylindrical member 12 with the cylindrical member 18. The open lower end 14 of the crown 12 may be provided with a sweat band or other structure adapting the cap to the head size of the wearer.

Extending peripherally of the crown portion 12 is a brim 20 in the form of a flange that is integral with or attached to the cylindrical crown 12. The brim 20 includes a lower flange or layer 22 and an upper flange or layer 24 defined by a peripheral groove 26 in the brim or flange 20. Positioned in the groove 26 is a plurality of alphabetical letters 28 having an aperture 30 in an inner corner thereof for receiving a rivet or other fastener 32 extending downwardly through aligned apertures 34 in the upper and lower layers 24 and 22 of the brim 20 as illustrated in FIG. 3 thus pivotally supporting the letter 28 from the brim 20 with the groove 26 defined by the lower flange or layer 22 and the upper flange or layer 24 providing a space into which the letter 28 may be pivoted so that it is concealed between the layers 22 and 24 as illustrated in broken line in FIG. 1.

As illustrated in FIG. 1, the flange or brim 20 is provided with a projection 36 at the forward or rearward end thereof so that the projection 36 combined with the flange 20 will simulate a large letter or figure. The projection 36 is provided with a curved edge 38 and a straight radial edge 40 thereby combining with the flange 20 when observed in plan view to closely simulate a letter of the alphabet such as "Q". The cylindrical crown portion 12 defines the center of the large circular flange 20 forming part of the alphabetical letter. The configuration of the brim or flange 20 may vary to simulate other letters of the alphabet having a large central circular area.

Figure 4:
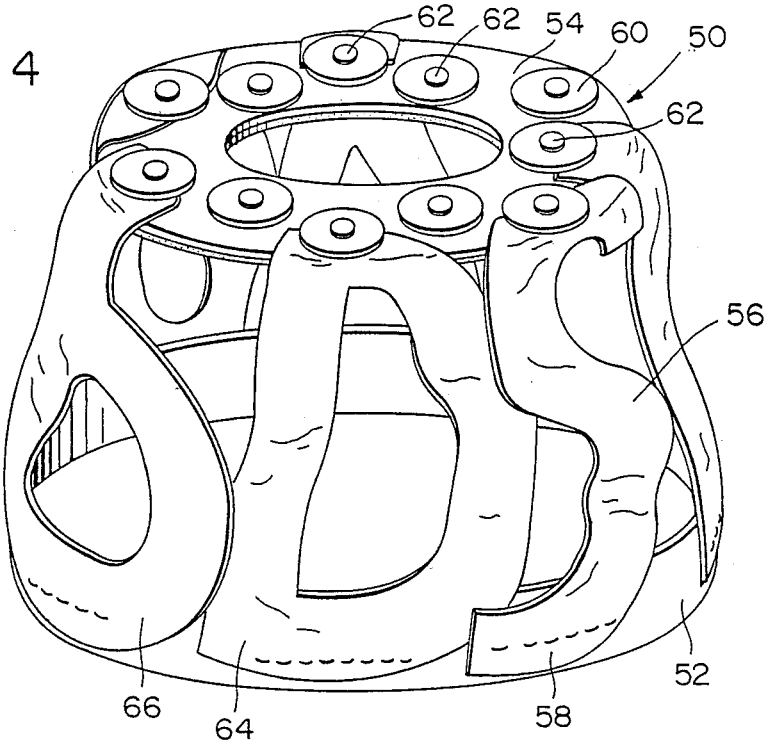
FIG. 4 is a perspective view of a modified form of the present invention.
Figure 5:
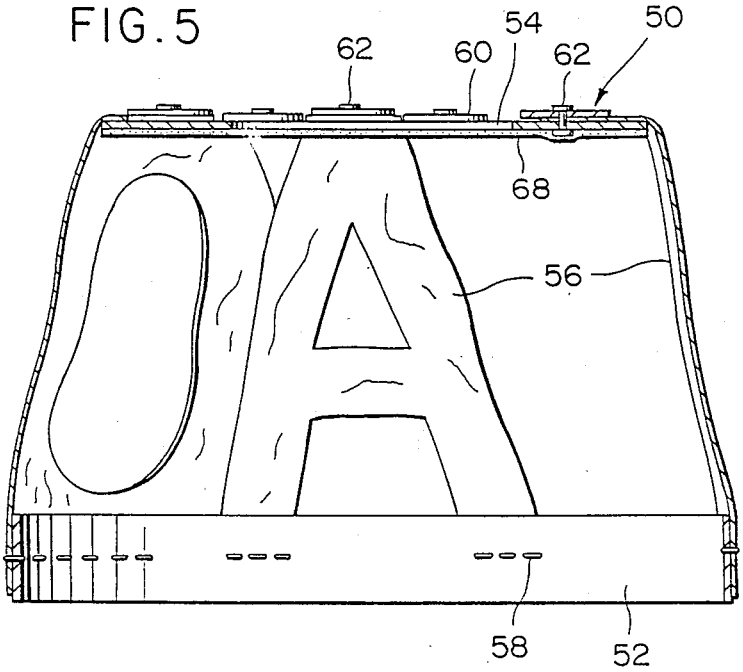
FIG. 5 is a transverse, sectional view of the construction of FIG. 4 illustrating the manner in which this embodiment of the invention is constructed.

FIGS. 4 and 5 illustrate another embodiment of the cap of this invention as designated by reference numeral 50 and which includes a crown portion defined by a lower band 52, an upper horizontally disposed annular member 54 and a plurality of letters, numerals or figures 56 interconnecting the band 52 and the top member 54 thus defining a crown portion which will engage over the crown portion of the head of a wearer.

The band 52 is of cylindrical construction and has the lower end of various letters or numbers 56 secured thereto as by stitching 58 or other fastening means and the upper end of the letters 56 ar secured to the annular horizontal member 54 by disc-like washers or similar structures 60 and rivets or other fasteners 62. The letters or numbers 56 are constructed of flexible fabric material such as felt or similar material and may include various alphabetical letters and numbers such as the letter "D" 64 and the numeral "6" as indicated by reference numeral 66. This construction enables the cap to be easily collapsed into a compact condition by moving the top annular member 54 downwardly to a position generally interiorly of the lower band 52. The letters or numerals 56 may be of any suitable colors, may contrast in colors or be the same colors and the top annular member 54 may include an interior fabric covering 68 where it comes into contact with the top of the head and other structural features may be provided to enable the band 52 to be adjusted in length so that it will fit heads of different sizes.

The hats disclosed may be provided with a lining which engages the surface of the head of the wearer and may also extend under the brim of the cap illustrated in FIGS. 1–3. The lining could be of various colors and may be either a solid color or of mixed colors to make the cap more attractive. The brim may be provided with a lining on the top surface as well as the bottom surface or only on the outer periphery of the brim to form a border of a desired color. The exterior surface of the crown portion in FIGS. 1–3 may be provided with a textile texture and may be of various colors and the lower edge or open bottom of the crown portion of each embodiment of the invention may be provided with a lining or a band of leather or similar material to serve as a sweat band such as is conventionally used on various hats and caps.

The cap brim may also be constructed as a separate component from the crown portion in which the brim itself extends forwardly at the front of the crown portion in the form of a visor or cap bill constructed in the outline of a letter, numeral or the like with the ends of the letter or numeral including twist-type straps which encircle the crown portion and which can be twisted together or stitched to the crown portion or otherwise secured thereto to enable interchangeability of the letters or numbers. Likewise, the letters or numerals may be stitched, glued or otherwise attached directly to the crown portion which can be constructed of various materials including plastic, rubber, fabric, textiles, leather and the like.

In the embodiment illustrated in FIGS. 4 and 5, when a letter is used with crossing segments such as the letter "X", the crossed portions of the letter may be stitched to increase the strength of the letter and the upper and lower ends of the crossed pieces may be stitched to the lower band and the top annular member. Also, a cap can be attached to the top annular member by stitching, rivets or other fastening means so that when observed in plan, the top of the annular member will reveal a letter or number to that observer. Also, the open construction of the letters enables a person's hair to project out through each letter and through the areas between the letters or numerals. As in FIGS. 1–3, the entire cap of FIGS. 4 and 5 can be constructed of textile material, plastic, rubber or any other desired material constructed in a conventional and well-known manner with various color combinations being included. As illustrated in FIGS. 4 and 5, the top annular member itself serves as the letter "O" and may be constructed in other letter configurations with the top edges of the side letters being connected thereto in any suitable manner with the side edges of the side letters being connected by stitching if desired thus further providing a strengthening connection for the components of the cap.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An article of headwear comprising a peripheral crown portion adapted to receive and be mounted on the crown portion of the head of a wearer, said crown portion including an annular lower end opening downwardly to provide access into the interior of the crown portion, said crown portion including a top member at the upper end thereof, and indicia supported from the crown portion in the form of letters, numerals, symbols and the like, said crown portion being continuous from the open lower end to the top member, and a peripheral brim supported from the crown portion adjacent the open lower end thereof, said brim forming means supporting the letters, numerals, symbols and the like, said brim including upper and lower layers spaced vertically from each other around the peripheral edge thereof, said indicia including a plurality of indicia forming members having a peripheral portion pivoted between the layers of the brim for movement of the indicia forming members between a concealed position totally between the layers of the brim and a revealed position having the major portion thereof extending laterally outwardly from the brim to enable observation of the indicia forming members, said indicia forming members being in the form of letters, numerals, symbols and the like.

2. The structure as defined in claim 1 wherein said top member is a continuous substantially circular member, said crown portion being generally cylindrical in configuration and of a larger diameter than the top member with the top member being connected to the crown portion through a short vertical wall portion and an outwardly curved upper end portion at the top of the crown portion, said top member and crown portion being delineated from the brim whereby the brim when observed in plan forms a letter, numeral, symbol and the like.

3. The structure as defined in claim 2 wherein said brim includes a lateral projection at the forward portion of the hat with the brim and lateral projection combining to form a letter, numeral, symbol and the like.

4. An article of headwear comprising a peripheral crown portion adapted to receive and be mounted on the crown portion of the head of a wearer, said crown portion including an annular lower end opening downwardly to provide access into the interior of the crown portion, said crown portion including a top member at the upper end thereof, and indicia supported from the crown portion in the form of letters, numerals, symbols and the like, said crown portion including an annular top member in the form of a letter, numeral, symbol and the like, a lower band, a plurality of side members extending between the top member and lower band, and fastening means securing the side members to the annular top member and band, said side members being in the form of letters, numerals, symbols and the like, said side member being constructed of flexible material to enable the top portion and band to move towards each other as the flexible side members fold, said side members include open spaces delineating said letters, numerals, symbols and the like to permit the hair of a wearer to project therethrough and to provide ventilation, said fastening means securing the lower ends of the side members to the exterior of the band, the upper ends of the side members overlying the upper surface of the top member with the fastening means extending vertically therethrough.

* * * * *